US011713880B1

(12) United States Patent
Newby et al.

(10) Patent No.: US 11,713,880 B1
(45) Date of Patent: Aug. 1, 2023

(54) FIREPIT TOPPER

(71) Applicant: Cast Masters LLC, Myrtle Beach, SC (US)

(72) Inventors: Sylvan Newby, Myrtle Beach, SC (US); Bryan Devereux, Myrtle Beach, SC (US); Brian Baldonado, Myrtle Beach, SC (US); Marc Devereux, Myrtle Beach, SC (US); Bertrand Valero, Charleston, SC (US)

(73) Assignee: Cast Masters LLC, Myrtle Beach, SC (US)

( * ) Notice: Subject to any disclaimer, the term of this patent is extended or adjusted under 35 U.S.C. 154(b) by 0 days.

(21) Appl. No.: 18/103,018

(22) Filed: Jan. 30, 2023

(51) Int. Cl.
*F23M 9/10* (2006.01)

(52) U.S. Cl.
CPC ..... *F23M 9/10* (2013.01); *F23M 2900/09062* (2013.01)

(58) Field of Classification Search
CPC ..... F21L 23/00
USPC ..... 126/519
See application file for complete search history.

(56) References Cited

U.S. PATENT DOCUMENTS

D156,619 S 12/1949 Greene
4,041,930 A * 8/1977 Katona ..... F24C 15/006 126/200
5,524,609 A 6/1996 Krull
6,261,088 B1 * 7/2001 Butler ..... F21V 35/00 431/290
D486,212 S 2/2004 Laudenbach
6,733,279 B2 * 5/2004 Thigpen ..... F21S 13/12 431/298
6,769,906 B1 * 8/2004 Grove ..... F24C 3/006 126/519
7,097,448 B2 * 8/2006 Chesney ..... F23C 7/002 362/171
7,175,424 B2 * 2/2007 Frink ..... F23D 14/28 239/18
D583,504 S 12/2008 Fujiwara
D589,207 S 3/2009 Fujiwara
D621,873 S * 8/2010 Tsai ..... D19/26
D622,318 S * 8/2010 Tsai ..... D19/62
8,542,987 B2 * 9/2013 Yen ..... F24H 3/00 431/126
8,641,413 B2 * 2/2014 Chen ..... F23C 7/02 431/300

(Continued)

FOREIGN PATENT DOCUMENTS

WO WO2015124051 8/2015

OTHER PUBLICATIONS

Table Torches; available at https://www.halofiretorch.com/collections/table-torches. Last Accessed Dec. 1, 2022.

(Continued)

*Primary Examiner* — David J Laux
(74) *Attorney, Agent, or Firm* — Maskell Law PLLC; Benjamin E. Maskell

(57) ABSTRACT

Disclosed is a firepit topper having a plate having a top side and a bottom side, a central opening of the plate, a first channel partially surrounding the central opening, a second channel partially surrounding the central opening, and an end of the first channel that is offset with respect to an end of the second channel.

16 Claims, 6 Drawing Sheets

(56) References Cited

U.S. PATENT DOCUMENTS

| | | | | |
|---|---|---|---|---|
| 8,776,777 | B2 * | 7/2014 | Jin | F24C 3/042 126/91 A |
| 9,170,017 | B2 * | 10/2015 | Shimek | F23C 7/004 |
| D742,490 | S | 11/2015 | Jepson | |
| 9,360,208 | B2 * | 6/2016 | Chen | F23C 7/002 |
| 9,377,187 | B2 * | 6/2016 | Chen | F23C 7/002 |
| 9,557,051 | B2 * | 1/2017 | Chen | F23D 14/04 |
| 9,726,368 | B2 * | 8/2017 | Chen | F23D 3/20 |
| 10,101,036 | B2 * | 10/2018 | Fuller | F24C 15/002 |
| 10,330,313 | B2 | 6/2019 | Huang | |
| D864,885 | S | 10/2019 | Kobayashi | |
| D880,763 | S | 4/2020 | McNamara | |
| 10,920,987 | B2 * | 2/2021 | Myers | F23B 60/02 |
| 2004/0261780 | A1 * | 12/2004 | Frink | F24C 3/006 126/519 |
| 2009/0016048 | A1 * | 1/2009 | McBrien | F21L 17/00 362/180 |
| 2012/0006316 | A1 * | 1/2012 | Shimek | F23L 1/02 126/518 |
| 2012/0178035 | A1 * | 7/2012 | Chen | F23D 5/04 431/354 |
| 2012/0231403 | A1 * | 9/2012 | Chen | F23C 7/02 431/353 |
| 2013/0011800 | A1 * | 1/2013 | Chen | F23D 5/045 431/344 |
| 2013/0252188 | A1 * | 9/2013 | Chen | F23D 14/10 431/355 |
| 2014/0290643 | A1 * | 10/2014 | Potter | F24B 1/181 431/126 |
| 2015/0354817 | A1 * | 12/2015 | Fuller | F24H 9/0068 126/90 R |
| 2016/0174766 | A1 | 6/2016 | Schlosser | |
| 2018/0051886 | A1 * | 2/2018 | Myers | F23B 80/04 |
| 2021/0048188 | A1 | 2/2021 | Harrington | |
| 2022/0196247 | A1 * | 6/2022 | Ressler | F24B 3/00 |
| 2022/0397275 | A1 | 12/2022 | Hensrud | |
| 2023/0009412 | A1 * | 1/2023 | Dillon | F24C 3/14 |

OTHER PUBLICATIONS

Machine Translation of WO2015124051 of Haung.

* cited by examiner

FIREPIT TOPPER

BACKGROUND OF THE INVENTION

Field of the Invention

The embodiments of the invention relate to firepits, and more particularly, to a firepit adapted for production of aesthetically pleasing flame production. Although embodiments of the invention are suitable for a wide scope of applications, it is particularly suitable for aesthetic enlargement of a flame for table top fire pits.

Discussion of the Related Art

The related art includes generally firepits having generally a containment vessel such as a bowl or pit and an open top. Fuel such as wood or other combustible material can be added to the containment vessel and burned. The related art firepit can generally contain the combustible material and is ideal to prevent undesired spreading of fire and to contain ash and debris created by fire. The related art includes generally grates or grills for grilling as well as flat tops for converting firepits for use as a table or work surface when not in use.

Firepits of the related art, however, are not commonly optimized for air flow. Some firepits of the related art may include fans to increase airflow. But, fans generally require electrical power and are prone to failure in from heat created by the firepit. Accordingly, related art fire pits may not reach their full potential in terms of completely combusting fuel, and correspondingly emitting heat and flame.

SUMMARY OF THE INVENTION

Accordingly, embodiments of the invention are directed to a firepit topper that substantially obviates one or more of the problems due to limitations and disadvantages of the related art.

An object of embodiments of the invention is to provide a firepit that amplifies the flame for aesthetic purposes;

Another object of embodiments of the invention is to provide a firepit that provides more efficient fuel combustion;

Yet another object of embodiments of the invention is to provide a firepit that emits more heat than similarly sized firepits;

Still another object of embodiments of the invention is to provide a firepit having protection of the flame to reduce prospective injury.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a firepit topper includes a plate having a plate having a top side and a bottom side, a central opening of the plate, a first channel partially surrounding the central opening, a second channel partially surrounding the central opening, and an end of the first channel that is offset with respect to an end of the second channel.

In another aspect, firepit topper includes a plate, a central opening of the plate, a first, second, third, and fourth support members collectively surrounding the central opening, a first channel formed between the first and second support members, a second channel formed between the third and fourth support members, a first end of the first channel, and a first end of the second channel disposed farther from the central opening than the first end of the first channel.

In yet another aspect, a firepit topper includes a plate, a central opening of the plate, a first channel of the plate, a second channel of the plate, a first end of the first channel; a first end of the second channel disposed farther from the central opening than the first end of the first channel, a first safety guard partially disposed in the first channel and extending upwardly from the plate, a second safety guard partially disposed in the second channel and extending upwardly from the plate; and an airgap between a vertical edge of the first safety guard and a vertical edge of the second safety guard.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1A:
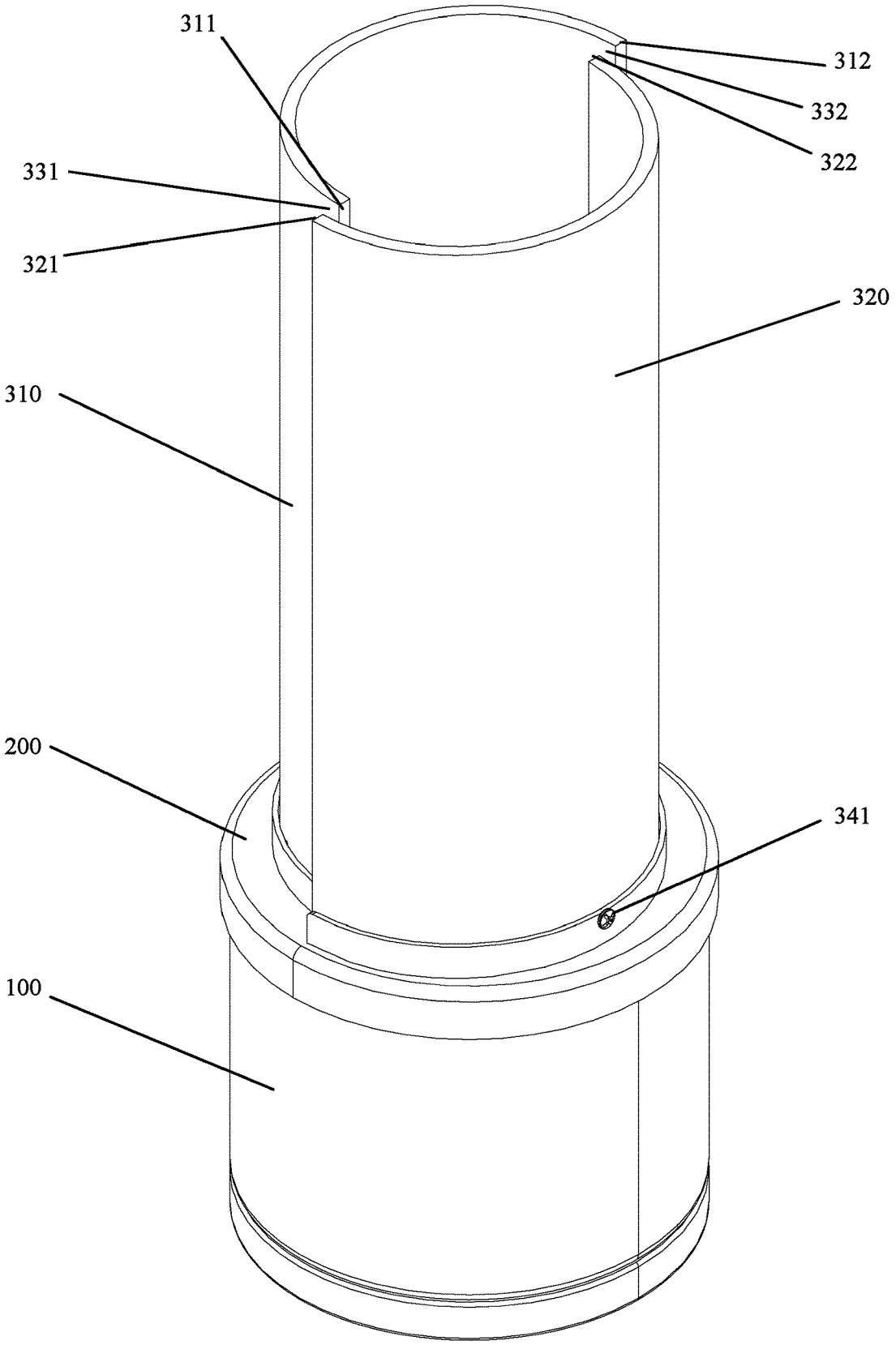
FIG. 1A is an isometric view of a firepit with a firepit topper and safety guards according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 1B:
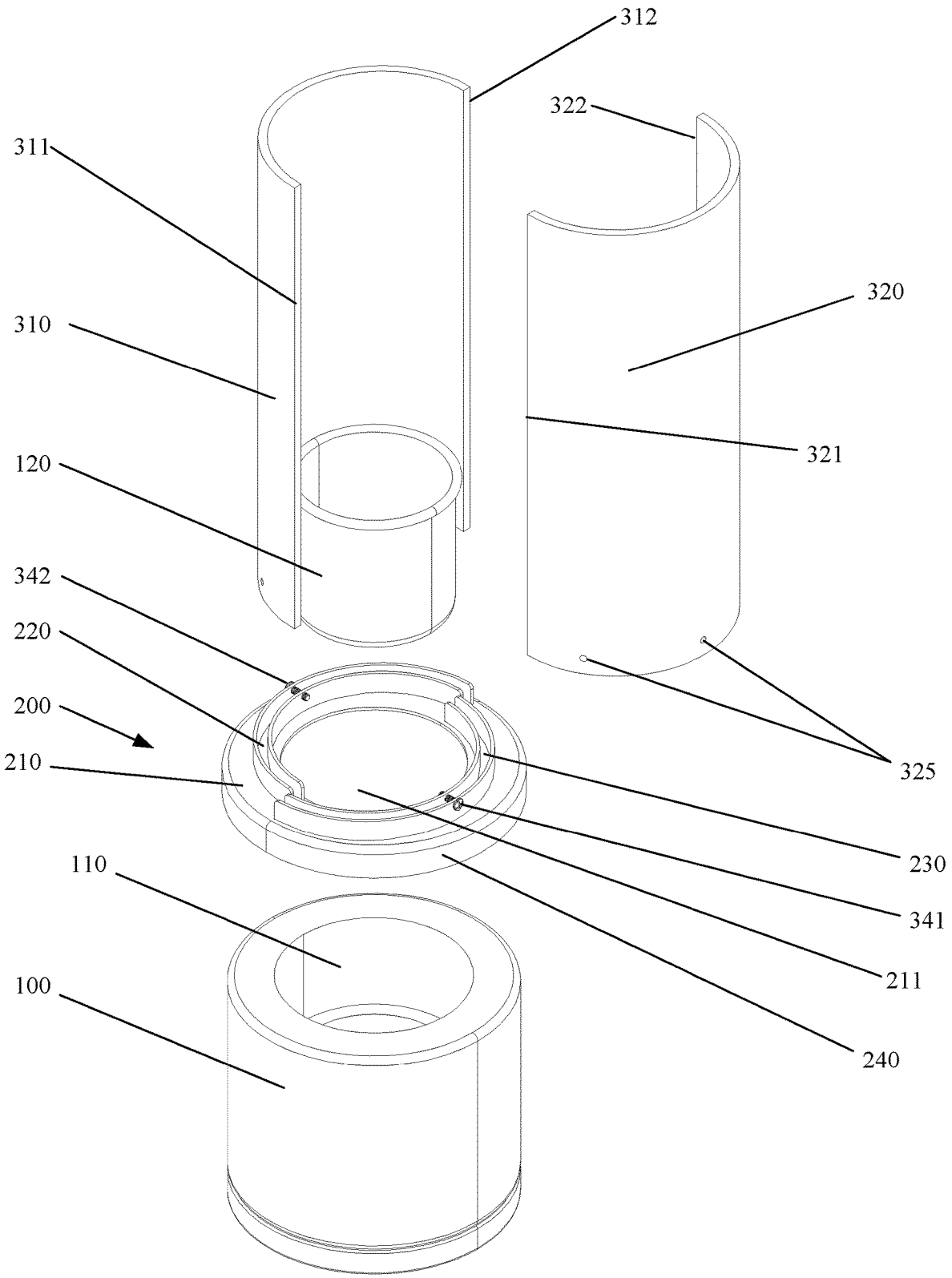
FIG. 1B is an assembly view of a firepit with a firepit topper and safety guards according to an exemplary embodiment of the invention.

FIG. 1A is an isometric view of a firepit with a firepit topper and safety guards according to an exemplary embodiment of the invention and FIG. 1B is an assembly view of a firepit with a firepit topper and safety guards according to an exemplary embodiment of the invention. As shown in FIG. 1A and FIG. 1B, a firepit base 100 can have a central recess 110 and removable cup 120. Firepit topper 200 can have a plate 210, central hole 211, channels 220 and 230, and flange 240. Safety guard 310 can have edges 311 and 312.

Safety guard 320 can have edges 321 and 322. Safety guards 310 and 320 may have one more holes, e.g. holes 325 of safety guard 320. Safety guards can have airgaps 331 and 332 and screws 341 and 342.

Central recess 110 of base 100 can be sized in approximate proportions to receive optional removable cup 120. Fuel can be loaded directly into central recess 110 or into optional removable cup 120. Accordingly, either of central recess 110 or into optional removable cup 120 can be a fuel reservoir. Embodiments of the invention having removable cup 120 can be facilitate easy loading of fuel and easy cleaning of the firepit.

Firepit topper 200 can be disposed on top of base 100. Flange 240 can extend downwards from plate 210. Flange 240 can be an annular ring extending downwards from an outer periphery of plate 210 and sized in approximate dimensions to be slidably received over base 100.

Although embodiments of the invention illustrate the flange 240 as a continuous cylinder extending downwards from the outer periphery of plate 210, the flange 240 is not limited to the embodiment shown and alternative embodiments of the flange are contemplated and within the scope of the invention. By way of non-limiting example, a flange can alternatively be disposed on an inner periphery of plate 210 around central hole 211 and could correspondingly be received in central recess 110. In another example, a flange can be formed from multiple tabs or protrusions extending downwards from plate 210 in varying positions to engage corresponding features of base 100 and generally disposed to position plate 210 with respect to base 100 and limit lateral sliding.

Channels 220 and 230 of plate 210 can surround central hole 211. Channels 220 and 230 can generally form a discontinuous circular channel. Channels 220 and 230 can be offset such that ends of channels 220 and 230 do not align. An end of channel 220 can be slightly closer to the central hole 211 than a corresponding end of channel 230. An opposite end of channel 220 can be slightly farther from central hole 211 than a corresponding end of channel 230. Although embodiments of the invention have been illustrated as having two channels, three, four, or more channels having offset or discontinuous ends are contemplated and within the scope of the invention. Although embodiments of the invention illustrate channels 220 and 230 as being formed between upstanding sidewalls on a surface of the plate 210, channels could alternatively be formed as recesses or cutouts in the surface of plate 210. Alternatively, channels could also be formed by a series of upstanding positioning members that collectively define one or more channels. Alternatively, a channel can be formed by a single upstanding sidewall or upstanding support member for supporting a safety guard on a single side and the safety guard can be attached to such upstanding sidewall or support member. Although the upstanding sidewalls and support members have been shown and described generally as features disposed on the top surface of plate 210, upstanding sidewalls or support members can be part of or coextensive with flange 240 or sidewalls of a body of the firepit. Although channels 220 and 230 are illustrated as curved, other shapes of channels, including straight channels are contemplated and within the scope of the invention. By way of non-limiting example, four straight channels can be formed where each channel has an end slightly close to the central hole than an adjacent panel. Accordingly, all of the foregoing can be considered channels and within the scope of the invention.

Safety guards 310 and 320 can be sized in approximate proportions to be received in channels 220 and 230, respectively. Safety guards 310 and 320 can have a hole on a bottom edge (e.g. holes 325) that can receive a screw to attach the safety guard to topper 200. When safety guards 310 and 320 are installed in channels 220 and 230, respectively, an airgap 331 can form between edges 311 and 321 and an airgap 332 can form between edges 312 and 322.

When a fire is lit in the base 100, warm air from the fire can rise through safety guards 310 and 320. As the warm air rises, negative pressure can be created near the base of the fire. Negative pressure can cause air to be sucked in through airgaps 331 and 332 further feeding the fire. The positioning of airgaps 331 and 332 can cause fresh air to be directed to inner surfaces of safety guards 310 and 320 and create a swirling, rising, vortex of air between safety guards 310 and 320. The air current can cause the fire to be drawn upwards and appear bigger and more aesthetically pleasing. The air current can cause the fire to have additional oxygen and burn the fuel faster. The air current can cause the fire to have additional oxygen and facilitate more complete combustion of fuel. The air current can cause the fire to appear to be swirling like a tornado.

Safety guards 310 and 320 are preferably formed from heat treated and break resistant glass. Topper 200 is preferably formed from metal. Base 100 is preferably formed from masonry, turned stone, or metal. Removable cup 120 is preferably formed from metal.

Figure 2A:
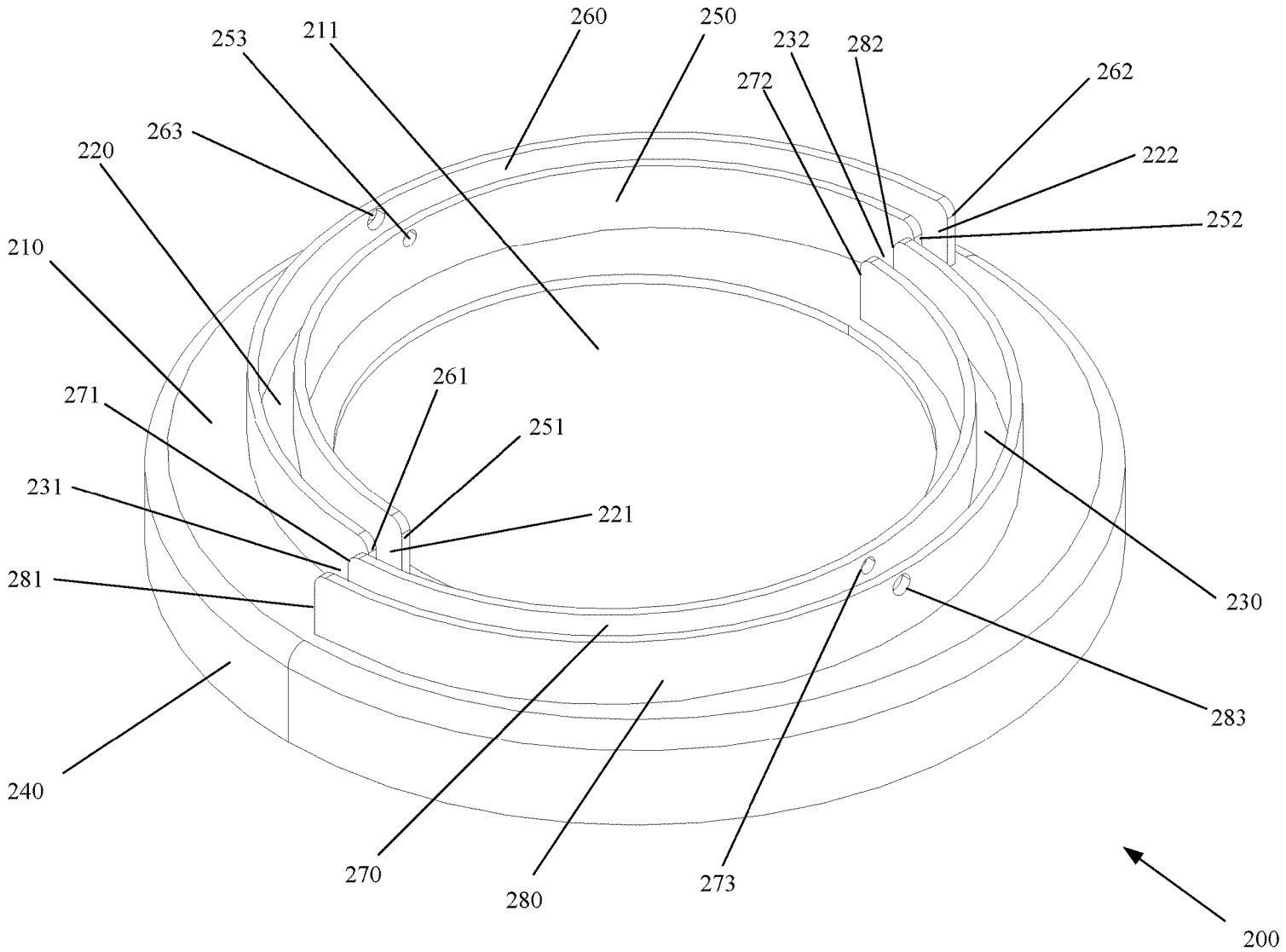
FIG. 2A is an isometric top-view of a firepit topper according to an exemplary embodiment of the invention.
Figure 2B:
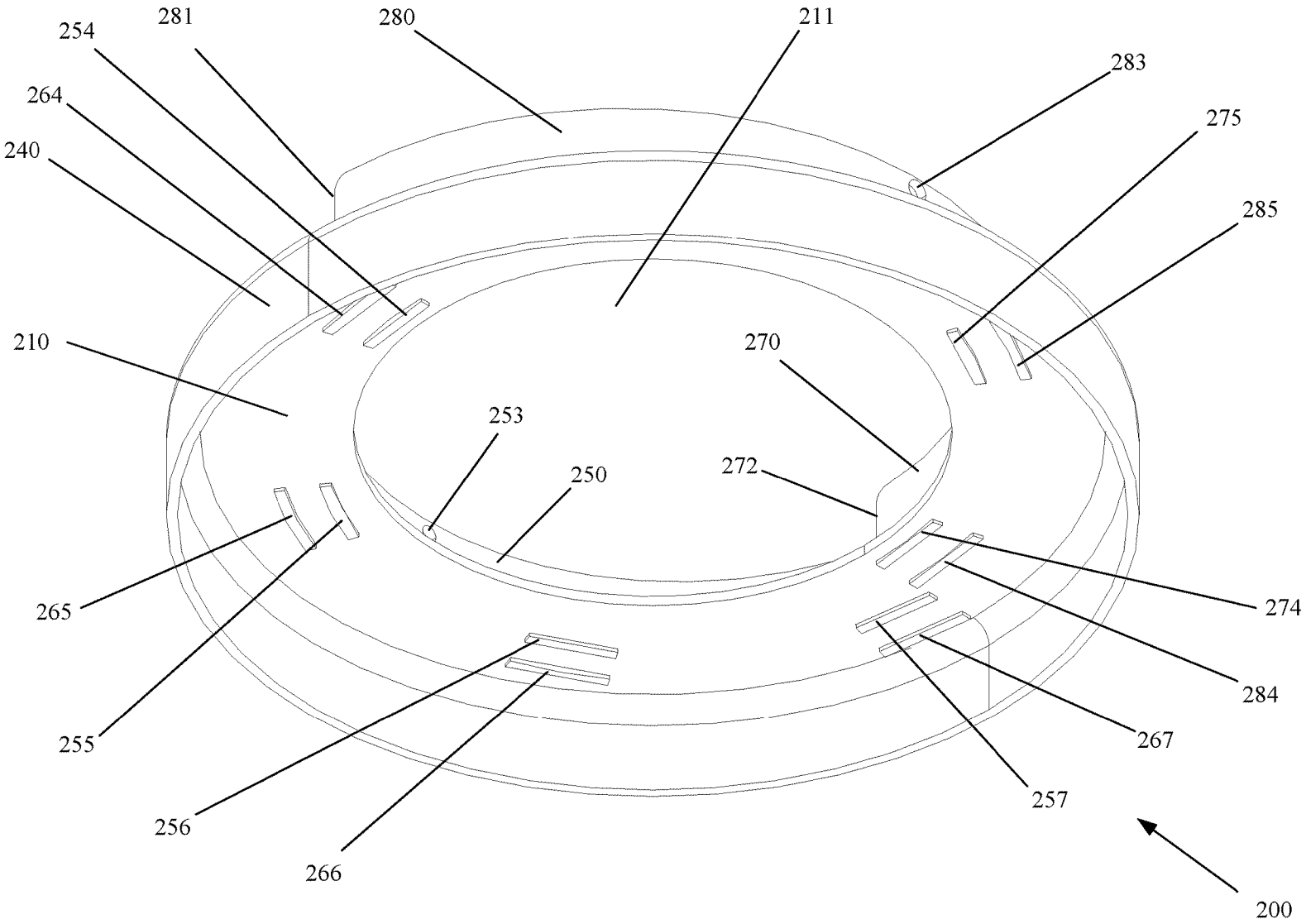
FIG. 2B is an isometric bottom-view of a firepit topper according to an exemplary embodiment of the invention.
Figure 3:
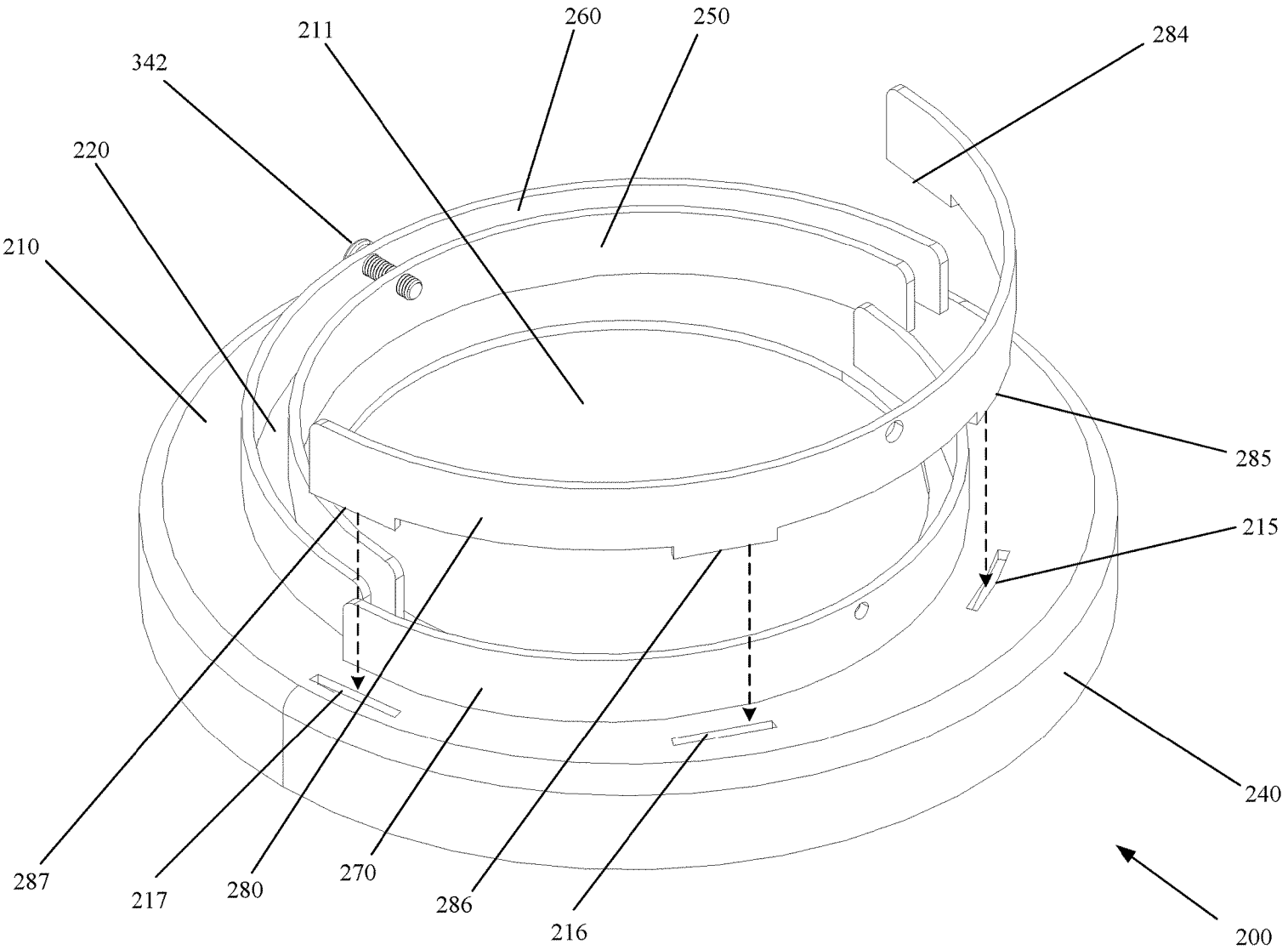
FIG. 3 is an assembly view of a firepit topper according to an exemplary embodiment of the invention.

FIG. 2A is an isometric top-view of a firepit topper according to an exemplary embodiment of the invention, FIG. 2B is an isometric bottom-view of a firepit topper according to an exemplary embodiment of the invention, and FIG. 3 is an assembly view of a firepit topper according to an exemplary embodiment of the invention. As shown in FIG. 2A and FIG. 2B, a firepit topper has a plate 210 and a central hole 211. A flange 240 can extends downwards from an outer periphery of plate 210. Channel 220 can be formed from upstanding sidewalls 250 and 260. Channel 220 can have ends 221 and 222. Channel 230 can be formed from upstanding sidewalls 270 and 280. Channel 230 can have ends 231 and 232. Upstanding sidewall 250 can have ends 251 and 252 and hole 253. Upstanding sidewall 260 can have ends 261 and 262 and hole 263. Upstanding sidewall 270 can have ends 271 and 272 and hole 273. Upstanding sidewall 280 can have ends 281 and 282 and hole 283.

Sidewalls 250, 260, 270, and 280 can each have one or more tabs (e.g. tab 285) to facilitate connection to plate 210 via slots (e.g. slot 215.) In the embodiment illustrated in FIG. 2A, FIG. 2B, and FIG. 3, sidewalls 250, 260, 270, and 280 can each have four tabs that correspond to slots in plate 210. Some tabs and slots may be obscured in the illustrations of FIG. 2A, FIG. 2B, and FIG. 3 but connect in similar matter as tabs 285, 286, and 287 of sidewall 280 to slots 215, 216, and 217. By way of example, the corresponding slot for tab 284 is obscured by sidewall 270 in FIG. 3, but those of skill in the art would appreciate the size and location of the corresponding slot which can be seen in better detail with tab 284 inserted therein in FIG. 2B. Sidewall 250 can have tabs 254, 255, 256, and 257 that can be inserted (as shown) into corresponding slots (not labeled) of plate 210. Sidewall 260 can have tabs 264, 265, 266, and 267 that can be inserted (as shown) into corresponding slots (not labeled) of plate 210. Sidewall 270 can have tabs 274 and 275 and other tabs that are not shown but generally disposed in similar in configuration to tabs 284, 285, 286, and 287 of sidewall 280. Sidewall 280 can have tabs 285, 286, and 287. Once a tab is inserted into a corresponding slot, the tab can be secured to the plate to retain the sidewall on the plate. The tab can be secured by spot welding, pinching, or folding the tab to retain it in the slot.

Holes 253 and 263 of sidewalls 250 and 260, respectively, can be aligned and generally configured in relative proportions to receive a correspondingly sized screw. Safety guard 310 of FIG. 1A can have a hole corresponding in relative size and position to align with holes 253 and 263 and be secured by a screw (e.g. screw 342 of FIG. 1B). Holes 273 and 283 of sidewalls 270 and 280, respectively, can be aligned and generally configured in relative proportions to receive a correspondingly sized screw. Safety guard 320 of FIG. 1A can have a hole corresponding in relative size and position to align with holes 273 and 283 and be secured by a screw (e.g. screw 341 of FIG. 1B).

Generally, channels 220 and 230 can be offset as shown in FIG. 2A such that one of each channel is relatively closer to the central hole 211 than the other end. In the example of FIG. 2A, end 222 of channel 220 is farther away from the central hole 211 than end 232 of channel 230. End 221 of channel 220 is closer to the central hole 221 than end 231 of channel 231. Although channels 220 and 230 are illustrated generally as half circles, channels 220 and 230 can be greater than a half circle such that the respective ends over lap slightly.

When referring to the relative position of the ends of sidewalls and channels with respect to one another, the term "inside" can mean "closer to the central hole." End 251 of sidewall 250 can be inside of end 261 of sidewall 260. End 261 of sidewall 260 can be inside of end 271 of sidewall 270. End 271 of sidewall 270 can be inside end 281 of sidewall 280. End 221 of channel 220 can be inside of end 231 of sidewall 230. End 272 of sidewall 270 can be inside of end 282 of sidewall 280. End 282 of sidewall 280 can be inside of end 252 of sidewall 250. End 252 of sidewall 250 can be inside end 262 of sidewall 260. End 232 of channel 230 can be inside of end 222 of sidewall 220.

Figure 4:
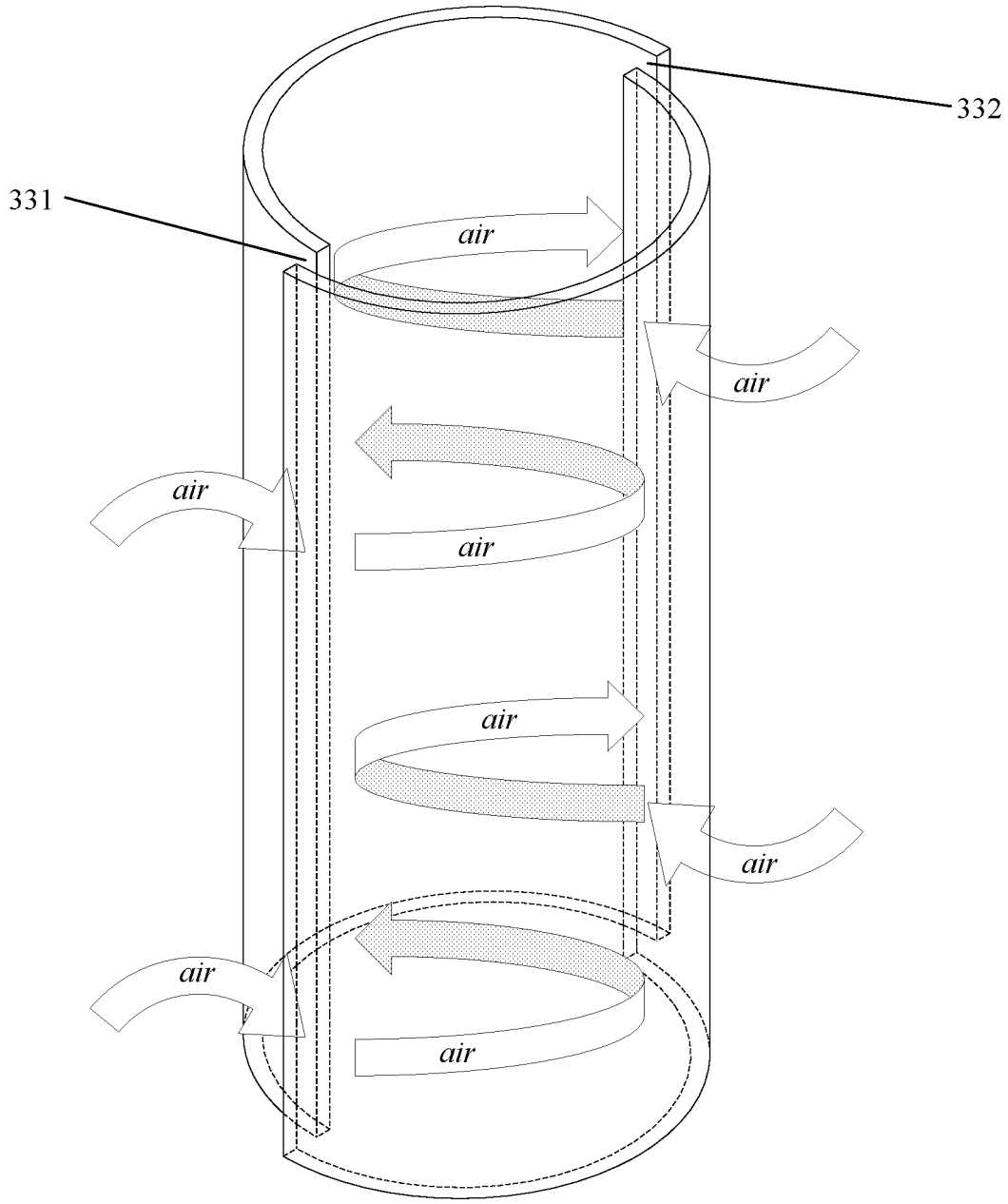
FIG. 4 is an airflow diagram according to an exemplary embodiment of the invention.

FIG. 4 is an airflow diagram according to an exemplary embodiment of the invention. As shown in FIG. 4, the relative position of channels and sidewalls as described in conjunction with FIG. 2A, 2B, and 3, can cause airgaps 331 and 332 to form between safety guards. The airgaps 331 and 332 can be approximately linear and extend the vertical length of the safety guards. As fuel is burned, hot gasses can rise through the safety guards. As the hot gasses rise, negative pressure can be formed in the inner space of the safety guards. Fresh air can be pulled in through airgaps 331 and 332 to normalize the pressure. Due to the shape and configuration of the airgaps 331 and 332 fresh air can be directed along the inner surfaces of the safety guards in a circular pattern. The airflow from airgaps 331 and 332 can cause a flame (not shown) to swirl between the safety guards and also keep the flame away from safety guards. The airflow from airgaps 331 and 332 can provide additional oxygen to facilitate complete combustion of fuel minimizing soot, ash, and debris emitted by the firepit. The airflow from airgaps 331 and 332 can cause improved combustion thereby making the flame larger and emit additional heat. A larger flame can be aesthetically pleasing.

It will be apparent to those skilled in the art that various modifications and variations can be made in the firepit topper without departing from the spirit or scope of the invention. Thus, it is intended that embodiments of the invention cover the modifications and variations of this invention provided they come within the scope of the appended claims and their equivalents.

What is claimed is:

1. A device for amplifying the visual appearance of a flame, the device comprising:

a plate, the plate having a top side and a bottom side;

a central opening of the plate;

a first channel partially surrounding the central opening;

a second channel partially surrounding the central opening;

an end of the first channel, the end of the first channel offset with respect to an end of the second channel; and a base;

a central recess formed in a top surface of the base for receiving fuel;

a flange extending from the bottom side of the plate; and wherein the flange positions the plate with respect to the base.

2. The device of claim 1 further comprising:

a first safety guard partially disposed in the first channel and extending upwardly from the plate;

a second safety guard partially disposed in the second channel and extending upwardly from the plate; and an airgap between an edge of the first safety guard and an edge of the second safety guard.

3. The device of claim 1 further comprising:

a first support member;

a second support member;

a third support member;

a fourth support member;

wherein the second support member is further from the central opening than the first support member;

wherein the fourth support member is further from the central opening than the third support member;

wherein the first channel is defined by the space between the first and second support members; and wherein the second channel is defined by the space between the third and fourth support members.

4. The device of claim 3 further comprising:

a first end of the first support member;

a first end of the second support member;

a first end of the third support member;

a first end of the fourth support member;

wherein the first end of the first support member is closer to the central hole than the first end of the second support member;

wherein the first end of the second support member is closer to the central hole than the first end of the third support member; and wherein the first end of the third support member is closer to the central hole than the first end of the fourth support member.

5. The device of claim 4 further comprising:

a second end of the first support member;

a second end of the second support member;

a second end of the third support member;

a second end of the fourth support member;

wherein the second end of the third support member is closer to the central hole than the second end of the fourth support member;

wherein the second end of the fourth support member is closer to the central hole than the second end of the first support member; and wherein the second end of the first support member is closer to the central hole than the second end of the second support member.

6. The device of claim 3 further comprising:

a hole in first support member aligned with a hole in the second support member.

7. The device of claim 6 further comprising:

a hole in the third support member aligned with a hole in the fourth support member.

8. The device of claim 3 further comprising:

a tab of the first support member disposed in a first cutout of the plate.

9. The device of claim 8 further comprising:

a tab of the second support member disposed in a second cutout of the plate;

a tab of the third support member disposed in a third cutout of the plate; and a tab of the fourth support member disposed in a fourth cutout of the plate.

10. A device for amplifying the visual appearance of a flame, the device comprising:

a plate;

a central opening of the plate;

a first, second, third, and fourth support members collectively surrounding the central opening;

a first channel formed between the first and second support members;

a second channel formed between the third and fourth support members;

a first end of the first channel;

a first end of the second channel disposed farther from the central opening than the first end of the first channel; and a base;

a central recess formed in a top surface of the base for receiving fuel;

a flange extending from the bottom side of the plate; and wherein the flange positions the plate with respect to the base.

11. The device of claim 10 further comprising:

a second end of the first channel; and a second end of the second channel disposed closer to the central opening than the second end of the first channel.

12. The device of claim 10 further comprising:

a first safety guard partially disposed in the first channel and extending upwardly from the plate;

a second safety guard partially disposed in the second channel and extending upwardly from the plate; and an airgap between a vertical edge of the first safety guard and a vertical edge of the second safety guard.

13. The device of claim 10 further comprising:

a hole in first support member aligned with a hole in the second support member; and a hole in the third support member aligned with a hole in the fourth support member.

14. The device of claim 10 further comprising:

a tab of the first support member disposed in a first cutout of the plate;

a tab of the second support member disposed in a second cutout of the plate;

a tab of the third support member disposed in a third cutout of the plate; and a tab of the fourth support member disposed in a fourth cutout of the plate.

15. A device for amplifying the visual appearance of a flame, the device comprising:

a plate;

a central opening of the plate;

a first channel of the plate;

a second channel of the plate;

a first end of the first channel;

a first end of the second channel disposed farther from the central opening than the first end of the first channel;

a first safety guard partially disposed in the first channel and extending upwardly from the plate;

a second safety guard partially disposed in the second channel and extending upwardly from the plate;

an airgap between a vertical edge of the first safety guard and a vertical edge of the second safety guard; and a base;

a central recess formed in a top surface of the base for receiving fuel;

a flange extending from the bottom side of the plate; and wherein the flange positions the plate with respect to the base.

16. The device of claim 15 further comprising:

a second end of the first channel;

a second end of the second channel disposed closer to the central opening than the second end of the first channel;

a second airgap between a second vertical edge of the first safety guard and a second vertical edge of the second safety guard.

* * * * *